United States Patent [19]

Douglas

[11] 4,169,591

[45] Oct. 2, 1979

[54] EXERCISE DEVICE FOR INVALIDS

[76] Inventor: Ormond S. Douglas, 108 E. Barrow, Dayton, Tex. 77535

[21] Appl. No.: 857,130

[22] Filed: Dec. 5, 1977

[51] Int. Cl.[2] ..... A63B 23/04

[52] U.S. Cl. ..... 272/144; 272/134; 128/25 R; 272/73

[58] Field of Search ..... 272/73, 130, 131, 133, 272/134, 144, DIG. 3; 128/25 R, 25 B; 188/344, 367

[56] References Cited

U.S. PATENT DOCUMENTS

| | | | |
|---|---|---|---|
| 532,298 | 1/1895 | Wallace | 188/344 |
| 2,057,811 | 10/1936 | Armstrong | 272/134 X |
| 2,484,153 | 10/1949 | Chaudoir | 272/73 |
| 2,641,250 | 6/1953 | Brockman | 128/25 R |
| 2,668,709 | 2/1954 | Boyko | 272/132 |
| 3,056,603 | 10/1962 | Levine et al. | 272/132 X |
| 3,058,742 | 10/1962 | Jaffe | 272/132 |
| 3,285,070 | 11/1966 | McDonough | 272/134 X |
| 3,540,435 | 11/1970 | Smith | 272/134 X |
| 3,713,437 | 1/1973 | Wiedmer | 128/25 B X |
| 3,848,870 | 11/1974 | Craig | 272/131 X |
| 3,887,180 | 6/1975 | Berman | 272/144 X |
| 3,910,571 | 10/1975 | Stenn | 272/132 |
| 3,918,710 | 11/1975 | Niebojewski | 272/134 X |
| 3,930,495 | 1/1976 | Marino | 272/73 X |

FOREIGN PATENT DOCUMENTS

| | | | |
|---|---|---|---|
| 22939 | of 1902 | United Kingdom | 188/344 |
| 6478 | of 1904 | United Kingdom | 188/344 |
| 115216 | 5/1918 | United Kingdom | 272/134 |
| 1048774 | 11/1966 | United Kingdom | 272/73 |

*Primary Examiner*—Richard J. Apley
*Attorney, Agent, or Firm*—James L. Jackson

[57] ABSTRACT

An apparatus is provided for exercising the limbs of a person lying in a prone position, for example a patient on a hospital bed, wherein the apparatus preferably is removably attachable to the head or foot of the bed and comprises a double crank supported above the surface of the bed in a position reachable and manually rotatable by the limbs of the patient. An adjustable braking means is also provided whereby the force required to rotate the double crank is adjustable, and means for attaching the hands or feet of the patient to the double crank are also provided.

8 Claims, 5 Drawing Figures

FIG. 1
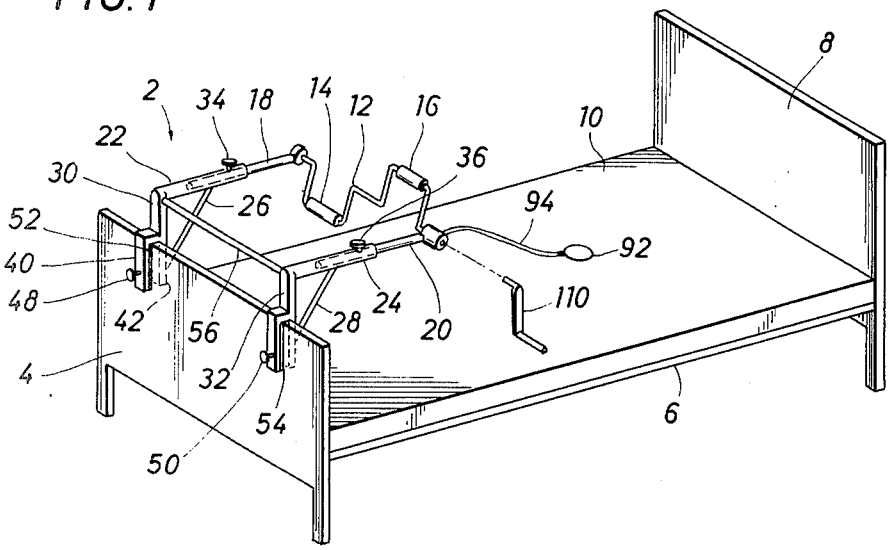
FIG. 3
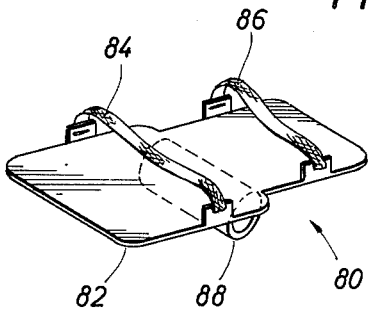
FIG. 2
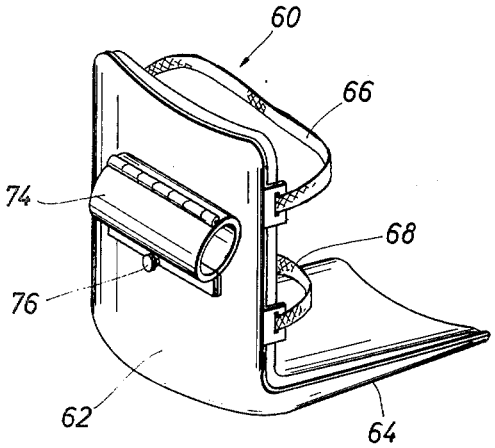
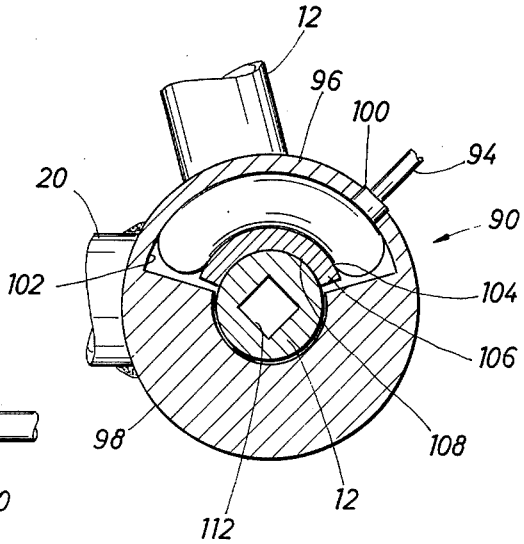
FIG. 5
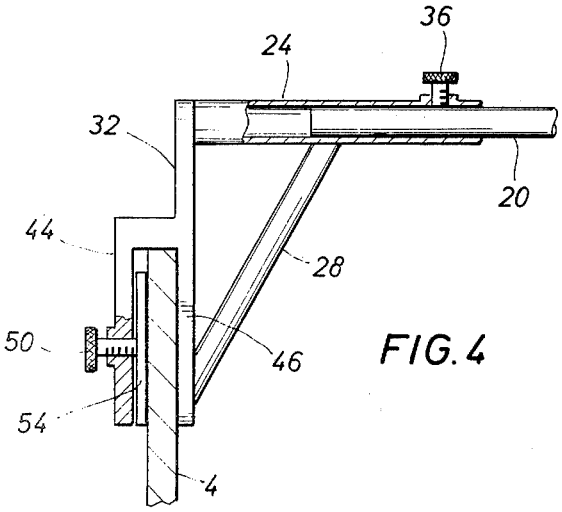
FIG. 4

EXERCISE DEVICE FOR INVALIDS

FIELD OF THE INVENTION

This invention relates generally to exercising devices, and more particularly, this invention relates to an apparatus for exercising the limbs of a patient in a prone position on a bed.

BACKGROUND OF THE INVENTION

Physical exercise of the human body is important for both physiological and psychological reasons. In the case of an individual confined to a bed either at home or in a hospital, movement of limbs is often limited, difficult or painful, either because of damage to the limbs themselves or damage to other parts of the body, or for other reasons.

Such inactivity on the part of a bedridden individual may actually hinder the healing processes, and lack of exercise may result in poor blood circulation and poor muscle tone. In addition, skyrocketing medical costs and the crowded conditions of most hospitals require that patients be rehabilitated as quickly as possible in order that they may free a hospital bed for another pztient.

For these and other reasons, apparatus for exercising the limbs of a person lying in a prone position have been developed and are well-known in the relevant industry. However, all of these apparatus suffer from one or more defects and deficiencies that make them impractical or unsuitable for their desired purpose.

One type of exercising apparatus found in the prior art is the type that is motor driven and moves the arms or legs of the patient rather than being manually moved by them. A few illustrative patents covering this type of device are Clark, U.S. Pat. No. 2,648,330; Kellogg, U.S. Pat. No. 3,455,295; and Hickey, U.S. Pat. No. 710,689. These devices are designed to *drive* the arms and/or legs of a patient rather than be *driven* thereby. Moreover, they are ungainly in appearance and cumbersome in construction. They are also not easily stored and are expensive to manufacture.

Two other examples of the prior art are Pettijohn, U.S. Pat. No. 2,630,332 and Swarts, U.S. Pat. No. 3,189,344. These devices, however, are not designed for use on, or in conjunction with, a bed. Pettijohn is intended as a vehicle for invalids, whereas Swarts is intended as a portable exerciser.

Because of the foregoing drawbacks of ungainly motor driven exercisers and exercisers not suitable for use in conjunction with a bed, other devices have been devised for exercising the limbs of a person lying in a prone position. Examples of such devices are Boyko, U.S. Pat. No. 2,668,709; Chaudoir, U.S. Pat. No. 2,484,153; and Wentz, U.S. Pat. No. 2,673,088.

Although Boyke, Chaudoir and Wentz are of simple, portable design adaptable for manual use on a sickbed, all of these devices except Boyke are designed primarily for exercise of the feet rather than the hands. And none of these devices can be removably affixed to a sickbed or the like in such a manner that they may be conveniently stored out-of-the-way from the normal use of the bed yet readily available for quick use.

It is thus seen by a review of the pertinent prior are that there are unique and heretofore unsolved problems associated with present devices for exercising the limbs of bedridden patients and the like.

With the foregoing in mind, it is therefore a primary object of the present invention to provide an apparatus for manually exercising the limbs of a bedridden patient that is removably attachable to either the head or foot of a bed in such a manner that it may be stored in a ready-to-use position that does not interfere with normal use of the bed.

It is a further important feature of the present invention that it is easily manufactured from inexpensive, readily-available components.

Another feature of the present invention is that it is preferably manually operated by either the arms or legs of the user, but may be driven externally, as by a hand crank or electric motor.

Another important feature of the present invention is to provide an adjustment means for adjusting the force required for operation of the device.

Another feature of the present invention is to provide attachment means for attaching the hands or feet of a user to the device.

A still further feature of the present invention is to provide a device for enhancing the healing, blood circulation and muscle tone of bedridden patients.

Other and further objects, features and advantages of the present invention will become apparent to one skilled in the art upon consideration of this entire disclosure. It is to be understood that the summary and detailed description of the preferred embodiments of this invention that follow hereinafter are not to be taken as limiting the scope of the present invention, but that they are merely illustrative of the objects and features of the present invention.

SUMMARY OF THE INVENTION

In accordance with the present invention, an apparatus is provided that may comprise an adjustable support frame for removably attaching the apparatus to either the head or the foot of a bed, a rotatable double crank supported by the support frame and a brake means for adjusting the amount of force required to rotate the double crank. The apparatus may also comprise attachment means for attaching the hands or feet of a user to the double crank.

The adjustable support frame is preferably of tubular construction and fits down over the headboard or footboard of a bed and clamps thereto. The support frame supports the double crank in a substantially horizontal position relative to the surface of the bed. The support frame may be adjusted to change the vertical and horizontal relationship of the double crank in relation to the surface of the bed. In particular, the adjustment of the support frame allows the exercise apparatus to be slid out of the way of the normal use of the bed and yet remain conveniently accessible should its use be desired.

The double crank, supported by the support frame, may be positioned horizontally above the bed in easy reach of either the feet or the hands of the user. It is also possible to use two exercise devices as disclosed herein to exercise both the arms and legs of a user simultaneously. Whether used singly or in pairs, the double crank is preferably manually rotated by the user in a pedaling action similar to that of a bicycle, and may be continued as long as is desired. Handle or sleeve means rotatable coaxially with respect to the crank are also provided.

When using the feet of a patient to rotate the crank, it may be advantageous to attach or strap the feet to the crank, for convenience or because of some physiological damage or weakening of the leg or feet muscles. Therefore, attachment means for attaching the feet to the crank, preferrably in conjunction with the handle means, are provided. In addition, similar physiological damage to the hands may be present that prevents the patient from gripping the handles, and therefore attachment means for attaching the hands to the crank, preferably in conjunction with the handle means, are also provided.

Where for some reason the legs or arms of a patient are damaged to the extent that they cannot manually rotate the crank, even with the use of the hand or foot attachment means, it may be desirable to strap the hands and/or feet of the patient to the crank and cause them to move by applying an external rotating force to the double crank. Therefore, a hand crank is provided for applying such external rotating force. The device is also suitably adaptable to have an electric motor or other non-manual apparatus supply a rotative force to the double crank.

A brake means is provided for adjusting the amount of rotative force required to rotate the crank. The brake means consists of an air bulb and a length of flexible tubing extending from the bulb to an expandable air bag adjacent the double hand crank. Squeezing of the air bulb causes air to be forced through the tubing and into the air bag. As the air bag expands it pushes a brake shoe against a brake pad on the double crank, thereby retarding its rotation. In this manner, the rotation of the double crank may be restricted. A suitable valve means is also provided to allow air to be expelled from the air bag, thereby relieving the retarding brake pressure. The length of flexible tubing allows the air bulb to be conveniently operated by a patient lying prone on the bed.

From the foregoing it is seen that this invention is a substantial and novel improvement over the prior art.

In the drawings:

FIG. 1 is a pictorial view of an exercise apparatus as contemplated by the present invention.

FIG. 2 is a pictorial view of a foot retaining device for attachment to the foot of a patient using the exercise apparatus depicted in FIG. 1.

FIG. 3 is a pictorial view of a hand retaining device for attachment to the hand of a patient using the exercise apparatus depicted in FIG. 1.

FIG. 4 is a side detail view, partially in section, of the clamping mechanism of the apparatus depicted in FIG. 1.

FIG. 5 is a side detail view, partially in section, of the brake mechanism of the apparatus depicted in FIG. 1.

DETAILED DESCRIPTION OF THE PREFERRED EMBODIMENTS

Referring now to the drawings, and to FIG. 1 in particular, there is depicted an exercise apparatus 2 constructed in accordance with the present invention. The apparatus 2 is attached to the footboard 4 of bed 6, but could just as easily be attached to headboard 8, as discussed hereinafter. Mattress 10 on which a patient would typically lie in a prone position is also shown.

The apparatus 2 comprises a double handcrank 12, which may be rotated in either direction, and which is provided with sleeves 14 and 16. These sleeves 14 and 16 are rotatable about their longitudinal axis coaxially with respect to the double handcrank 12, and enable a user to firmly grasp the sleeves and rotate the double handcrank without having the handcrank rotate within his grip.

The handcrank 12 is rotatably supported by suitable means at one extremity by movable support arm 18 and is rotatably supported at the other extremity by movable arm 20. Arms 18 and 20 are movably insertable in tubular members 22 and 24, respectively. Members 22 and 24 are in turn supported by brace members 26 and 28, respectively, and are attached to the footboard 4 of bed 6 by brackets 30 and 32, respectively. Crossbrace 56 may also be provided to brace and add strength to the device.

As has hereinbefore been described, the device is adjustable both vertically and horizontally in relation to the surface of the bed. In particular, and referring to FIGS. 2 and 4, the handcrank 12 may be moved inwardly and outwardly from the brackets 30 and 32. This is accomplished by loosening of the clamp screws 34 and 36 so that movable arms 18 and 20 may slide inwardly or outwardly within tubular members 22 and 24, respectively. The brackets 30 and 32, comprised of forks 40, 42 and 44, 46, respectively, removably and adjustably attach to footboard 4 (or headboard 8) by suitable means such as clamp screws 48 and 50, and clamp pads 52 and 54. Loosening of the clamp screws 48 and 50 allows the brackets 30 and 32 to be adjusted upwards or downwards on the footboard 4 or removed therefrom.

It may thus be seen that the handcrank 12 may be conveniently stored in an out-of-the-way position near the brackets 30 and 32 or suitably positioned outwardly from the brackets for use by a patient. In addition, the vertical height of the handcrank 12 over the surface of the mattress 10 may be adjusted by loosening clamp screws 48 and 50 and moving brackets 30 and 32 upwards or downwards.

Referring now to FIG. 2, a foot attachment means 60 is depicted. It comprises a sole plate 62 and a heel plate 64, foot straps 66 and 68, and hinged clamp 74 with locking means 76. Preferably, two such foot attachment means are provided so that both feet of a patient may be attached to the double crank 12 by engaging clamp 74 of each foot attachment means over each respective sleeve 14 and 16. In this manner, the apparatus may be operated by the feet of a patient lying in a prone position wherein the feet are conveniently secured to the double crank and the crank is rotated by the peddling action of the feet.

Referring now to FIG. 3, a hand attachment means 80 is depicted. It comprises a plate 82, straps 84 and 86, and hinged clamp 88 which is lockable similar to hinged clamp 74. Preferably, two such hand attachments are provided so that both hands of a patient may be attached to the double crank 12 by engaging clamp 88 over each respective sleeve 14 and 16. In this manner, the apparatus may be operated by the hands of a patient similar to the manner in which it is operated by the feet as described hereinabove.

Referring now to FIG. 5, a detailed view of a brake mechanism 90, partially in section, is shown. The brake mechanism is operated by repeatedly squeezing the air bulb 92 (FIG. 1), whereby air is drawn into the bulb and expelled into flexible tubing 94 by appropriate valve means (not shown) common with air bulbs of this type. Tubing 94 is affixed at its opposite extremity to airbag 96 inside brake drum 98 by suitable attachment means 100. Continued squeezing of bulb 92 causes the air in tubing 94 to expell into air bag 96, thereby inflating it.

As air bag 96 inflates, it expands against immovable inner wall 102 of drum 98 and against the upper surface 104 of movable brake shoe 106, thereby causing braking surface 108 of shoe 106 to exert retarding force on the double crank which extends through and is coaxial with the axis of drum 98.

It is thus seen that a retarding force may be easily and effectively applied to the double crank 12 by squeezing of bulb 92. A patient may adjust the amount of force required to rotate the double crank and therefore determine the amount of muscular exertion obtained by use of the device. In like manner, retarding force may be reduced by expelling of air from bag 96 through tubing 94 by opening a suitable exit valve means (not shown) on bulb 92. In operation and construction, for example, the air bulb may be similar to medical blood pressure testing devices.

Referring to FIG. 1, a hand crank 110 is shown. This hand crank inserts into aperture 112 in the end of double crank 12 (FIG. 5) and allows a nurse or other attendant to rotate the double crank externally. As hereinbefore described, this external hand crank feature is especially desirable for patients who are injured or incapacitated in such a manner that they cannot themselves adequately rotate double crank 12 but must instead have their limbs attached to it by means of foot attachment means 80 and have their limbs exercised by rotation of the double crank.

Having thus fully described my invention,

I claim:

1. An apparatus for exercising the limbs of a person lying in a bed having substantially rigid members at the head and foot portion thereof, said apparatus comprising:

an adjustable support frame removably attachable to either of the substantially rigid members at the head or the foot of said bed, said frame defining a pair of spaced, generally parallel support elements, said support elements being oriented in substantially horizontal manner when said frame is attached to said rigid members of said bed;

a pair of elongated support arms being received by said parallel support elements, said elongated arms being adjustably extendable relative to said support elements for horizontal positioning, bearing means being defined at the free extremities of said support arms;

a double crank rotatably supported by said bearing means and being positionable by said adjustable frame in a position reachable and rotatable by the limbs of said person; and brake means being defined by one of said bearing means for adjusting the force required for rotation of said double crank.

2. An apparatus as described in claim 1, wherein:

said adjustable support frame defines a pair of spaced bifurcated members each defining an elongated downwardly opening recess for receiving one of said rigid members;

clamp pad means being supported by each of said bifurcated members and being adjustable to secure said support frame to one of said rigid members and supporting said elongated support arms in a substantially horizontal position relative to the surface of said bed;

vertical adjustment of said double crank in relation to said bed being established by vertically positioning said rigid members within said elongated slots.

3. An apparatus as described in claim 1, wherein:

said double crank further comprises at lease one sleeve member rotatable with respect to said double crank and coaxially therewith.

4. An apparatus as described in claim 3 further comprising:

hand and foot connection means for attaching at least one hand or foot of said person to said double crank for rotation thereof.

5. An apparatus as described in claim 4, wherein:

said at least one attachment means attaches by suitable means to said at least one sleeve member.

6. An apparatus as described in claim 1 further comprising:

a pair of foot rests and a pair of hand rests, each pair being attachable by suitable means to respective ones of a pair of sleeve members on said double crank, said sleeve members rotatable coaxially with respect to said crank.

7. An apparatus as described in claim 1, further comprising:

an auxiliary crank means for externally applying rotating force to said double crank and thus cause manipulative movement of the limbs of said person.

8. An apparatus as recited in claim 1, wherein:

a portion of said crank defines a bearing and braking surface;

one of said bearing means is formed to define a brake drum;

a brake shoe being positioned within said brake drum in braking relation with said bearing and braking surface of said crank;

an air bag is positioned within said brake drum in engagement with said brake drum and said brake shoe; and an air bulb is interconnected with said air bag by an elongated air tube, upon compression of the air bulb by the patient or another, the air bag expands and increases the braking friction between the brake shoe and crank.

* * * * *